US006006498A

United States Patent [19]

Cleine

[11] Patent Number: 6,006,498

[45] Date of Patent: Dec. 28, 1999

[54] WRAPPING APPARATUS INCLUDING A SHUTTLE ORBITAL MOVEMENT AROUND AN OBJECT TO BE WRAPPED AND METHOD USING SAME

[75] Inventor: Kenneth David Cleine, Victoria, Australia

[73] Assignees: BHP Steel (JLA) Pty. Ltd., Melbourne; K.C. Metal Products Pty. Ltd., Dromana, both of Australia

[21] Appl. No.: 09/029,744

[22] PCT Filed: Sep. 20, 1996

[86] PCT No.: PCT/AU96/00597

§ 371 Date: May 26, 1998

§ 102(e) Date: May 26, 1998

[87] PCT Pub. No.: WO97/11018

PCT Pub. Date: Mar. 27, 1997

[30] Foreign Application Priority Data

Sep. 22, 1995 [AU] Australia ..... 32875

[51] Int. Cl.[6] ..... B65B 53/00

[52] U.S. Cl. ..... 53/441; 53/556; 53/389.4

[58] Field of Search ..... 53/349, 441, 556, 53/588, 210, 389.4; 242/418, 427.3

[56] References Cited

U.S. PATENT DOCUMENTS 3,669,370 6/1972 Mason ..... 242/418
3,936,007 2/1976 Butz ..... 242/418

(List continued on next page.)

FOREIGN PATENT DOCUMENTS 64 566/80 11/1980 Australia .
15835/80 5/1988 Australia .

(List continued on next page.)

*Primary Examiner*—Daniel B. Moon
*Attorney, Agent, or Firm*—Nikaido Marmelstein Murray & Oram LLP

[57] ABSTRACT

A wrapping apparatus is provided including a shuttle for orbital movement around an object to be wrapped, the shuttle carrying a feed roll from which a web of plastic film is drawn to wrap the object, the shuttle including a pre-stretching mechanism including: a braking roller mounted on the shuttle for rotation about an axis that is fixed relative to the shuttle; a stretching roller mounted on the shuttle for rotation about an axis which is fixed relative to the shuttle, parallel to the braking roller axis and spaced therefrom, the web being drawn directly from the feed roll around the stretching roller; drive transmission means connecting the rollers such that the surface speed of the stretching roller exceeds that of the braking roller; mandrel means for the rotational support of a feed roll of stretch wrap film mounted on the shuttle by guide means allowing the mandrel to move freely towards the braking roller under the influence of tension in a web of film drawn directly from the feed roll and passing around the stretching roller; and supplementary loading means acting independently of the web tension to supplement the effect of the web tension in urging the feed roll towards the braking roller to maintain braking contact therebetween. A method of wrapping at least part of an object in plastic film is provided including: loading a shuttle with a feed roll of the film, attaching an end of the film to the object; causing the shuttle to orbit at least part of the object; and pre-stretching the film as it is drawn from the feed roll by the relative movement between the object and the shuttle prior to its application to the object; wherein the feed roll is free to move bodily into contact with a braking roller under the effect of tension in the film departing from the feed roll and the step of pre-stretching the film is effected by of drawing the film directly from the feed roll around the stretching roller connected to the braking roller by drive transmission means ensuring that the surface speed of the stretching roller is greater than that of the braking roller, and augmenting the effect of the tension in the film in maintaining contact between the feed roll and the braking roller and having a value that is not dependent on the film tension.

8 Claims, 1 Drawing Sheet

U.S. PATENT DOCUMENTS

| | | | |
|---|---|---|---|
| 4,387,552 | 6/1983 | Lancaster et al. | 53/556 |
| 4,418,510 | 12/1983 | Lancaster, III et al. | 53/399 |
| 4,676,048 | 6/1987 | Lancaster et al. | 53/441 |
| 4,829,753 | 5/1989 | Briemont . | |
| 4,841,716 | 6/1989 | Roymberg | 53/556 |
| 5,282,347 | 2/1994 | Cleine et al. | 53/204 |
| 5,365,723 | 11/1994 | Ramos | 53/556 |
| 5,408,808 | 4/1995 | Masuda et al. . | |

FOREIGN PATENT DOCUMENTS

| | | |
|---|---|---|
| 24506/92 | 6/1993 | Australia . |
| 2 544 702 | 4/1983 | France . |

WRAPPING APPARATUS INCLUDING A SHUTTLE ORBITAL MOVEMENT AROUND AN OBJECT TO BE WRAPPED AND METHOD USING SAME

TECHNICAL FIELD

This invention relates to packaging processes in which an object to be packaged (which may be a single article or a plural assembly of articles) is wrapped in pre-stretched plastics film. More particularly, the invention relates to the mechanism used to stretch the film immediately before it is applied to the object. Such processes are frequently referred to as stretch wrapping processes and such mechanisms are frequently referred to as pre-stretching mechanisms.

BACKGROUND ART

Stretch wrapping utilises film having the property known as "memory", that is to say a tendency to recover its former shape or size, after having been strained beyond its elastic limit, some short while after the straining force has been relaxed.

Plastics wrapping film is normally provided to the user as a feed roll of unstretched film. Film is customarily drawn from the roll and applied to the object by securing an end of the film to the object, and then either rotating the object or orbiting the feed roll around the object. A number of types of pre-stretching mechanisms have been proposed hitherto whereby the web of film extending from the feed roll to the object is stretched as it is drawn from the roll before being applied to the object.

Such pre-stretching of the film is advantageous for a number of reasons, for example;

- the pre-stretched film may be applied to the object under a relatively low lay-up tension, as the subsequent contraction of the film ensures a desirably tight wrap (this is particularly advantageous when an assemblage of relatively small or lightweight articles is to be wrapped, because it reduces the likelihood of the articles being displaced by the wrapping process),
- moderate or properly controlled pre-stretching improves the mechanical properties of the film, and
- it is economical, in that a given weight of film may be extended to provide effectively more wrapping material.

The simplest and least desirable prior known pre-stretching apparatus merely applies a brake to the roll of film. Such apparatus is disclosed, for example, in U.S. Pat. No. 3,867,806 (Lancaster) and U.S. Pat. No. 4,077,179 (Lancaster). In these and other instances wherein a brake is applied to the feed roll, the stretching is induced by using a high lay-up tension. This suffers from the disadvantages inherent in the use of a high lay-up tension indicated above. Furthermore, stretching occurs throughout the whole length of the flight of web extending from the feed roll to the object, so that the overall increase in length is large, and becomes unmanageable unless the rate of pre-stretch is limited to undesirably low values. Furthermore, stretching over a long length of film causes excessive contraction in the width direction of the film.

An improvement on simple brake devices is disclosed in Australian patent No. 536099 (Lancaster), wherein the web of film is trained around two rollers interposed between the feed roll and the object to be wrapped. Those rollers are connected by drive transmission means such that they necessarily rotate at different speeds or in different directions.

This results in the stretching of the short length of web between the rollers.

Another prior art proposal is disclosed in Australian patent No. 589065 (Underhaug), wherein a braking roller in contact with the feed roll is connected to a stretching roller in contact with the drawn-off web by drive transmission means ensuring that the surface speed of the stretching roller is greater than that of the braking roller, so that a small and relatively constant length of web extending from the feed roll to the stretching roller is pre-stretched.

The braking and stretching rollers of the Underhaug device are mounted on a swinging lever whereby the web tension acting on the stretching roller is effective to load the braking roller against the feed roll. This ensures that braking contact between the braking roller and the feed roll is maintained as the feed roll diminishes in size. The lever introduces a mechanical advantage and ensures high pressure braking contact, indeed this is described as an advantage of the Underhaug device over its prior art.

In most respects the Underhaug device performs well when used in wrapping apparatus wherein the object to be wrapped rotates to draw a web of film from a positionally fixed feed roll. However it is not well adapted for use in wrapping apparatus (referred to hereinafter as "orbital wrapping apparatus) wherein the relative rotational motion between the object and the feed roll is effected by causing the feed roll to orbit around a positionally fixed object or part of an object, as exemplified in our Australian patent No. 653255.

In such orbital wrapping apparatus the feed roll is usually carried on an orbiting shuttle, which may be required to pass through the bore of an annular object, and which, for that reason, or merely to minimize the mass of the orbiting components, is kept as small as possible. The Underhaug pre-stretching mechanism, with its swinging lever, is not sufficiently compact for ready installation on a small shuttle. Furthermore, the orbital path of the shuttle is usually non-circular and inertial effects acting on the swing mounted stretching roller may affect the tension generated in the web.

The high braking efficiency of the Underhaug device, due to the high pressure between the braking roller and the feed roll arising from the mechanical advantage of the lever, while normally desirable, has been found to be a disadvantage under some circumstances, in particular when the shape of the object being wrapped and/or the shape of the orbital path are such that the rate of draw-off of web from the feed roll is erratic and subject to marked and sudden increases. In such instances the sudden increase in web tension needed to accelerate the feed roll causes a simultaneous severe application of the braking roller tending to prevent such acceleration. It has been found that, at best, this causes over stretching and, at worst, can cause the web to fail in tension and eventually snap.

DISCLOSURE OF INVENTION

Thus an object of the present invention is to provide pre-stretching mechanism of the Underhaug type which may be mounted for use on the shuttle of an orbital wrapping apparatus and which, wherever used, alleviates the over-braking problem inherent in the prior art Underhaug mechanism.

The invention achieves that object by providing a pre-stretching mechanism of the Undeuhaug type which eliminates the swinging lever while retaining sufficient braking pressure between the braking roller and the feed roll for steady operation and allowing momentary or short term slip between those components in the event of a sudden increase in web tension.

According to one aspect, the invention consists in a wrapping apparatus including a pre-stretching mechanism whereby, in use, a web of plastics film is drawn from a feed roll of film and applied to an object to be wrapped by virtue of orbital movement about the object of a shuttle carrying said roll, wherein the pre-stretching mechanism comprises a braking roller mounted on the shuttle for rotation about an axis that is fixed relative to the shuttle, a stretching roller mounted on the shuttle for rotation about an axis which is fixed relative to the shuttle, parallel to the braking roller axis and spaced therefrom, drive transmission means connecting the said rollers such that the surface speed of the stretching roller exceeds that of the braking roller, a mandrel for the rotational support of a feed roll of plastics film mounted on said shuttle by means maintaining the mandrel parallel to the roller axes but allowing the mandrel to move freely towards the braking roller under the influence, in use, of tension in a web of film drawn from the feed roll and passing around said stretching roller, and supplementary loading means acting independently of the web tension to augment the effect of the web tension in urging the feed roll towards the braking roller to maintain braking contact therebetween.

According to a second aspect, the invention consists in the pre-stretching mechanism itself for use in wrapping apparatus wherein relative rotational movement between an object to be wrapped and a feed roll of wrapping film is relied upon to draw film from the roll and apply it to the object.

BEST MODE OF CARRYING OUT THE INVENTION

Figure 1:
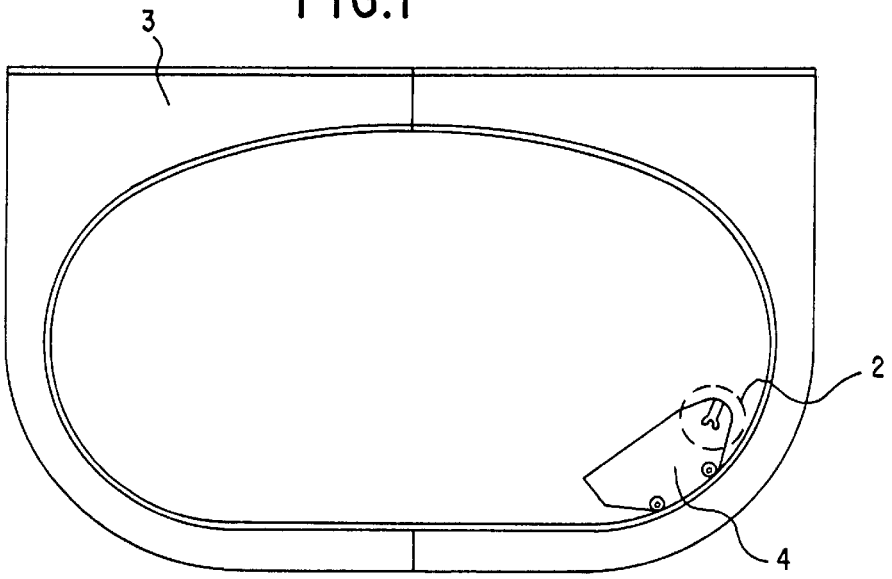
FIG. 1 is a diagrammatic side elevation of the essential components of an orbital wrapping apparatus.
Figure 2:
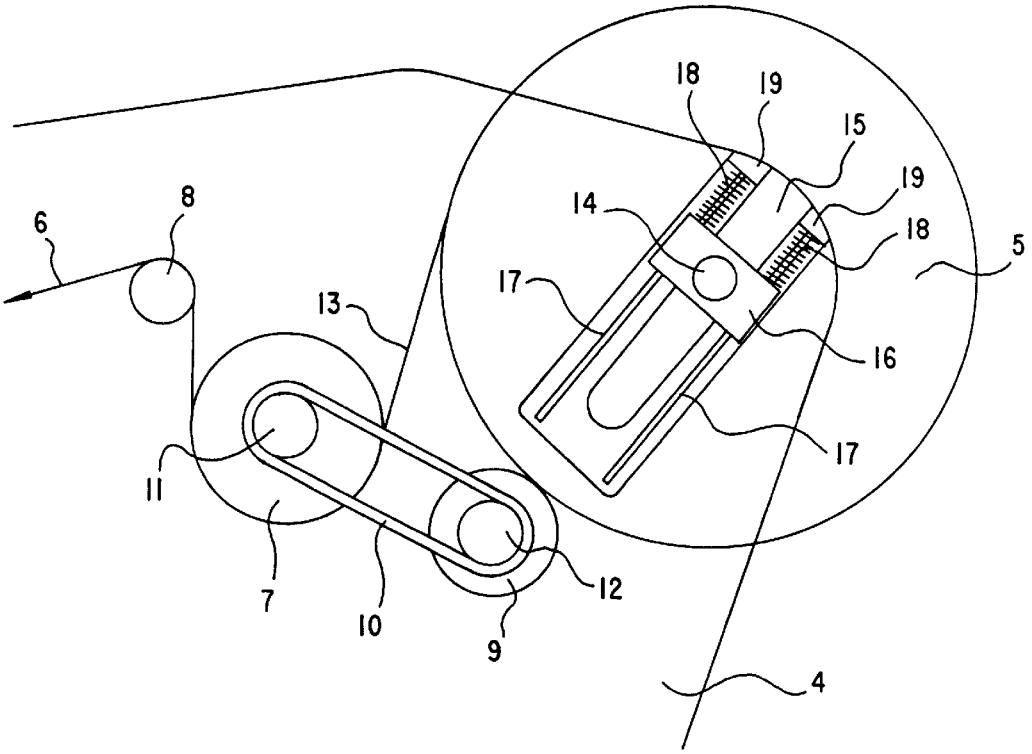
FIG. 2 is an enlarged diagrammatic side elevation of the components within the enclosure marked 2 in FIG. 1, being a shuttle mounted pre-stretching mechanism according to the invention, drawn to a larger scale.

By way of example, an embodiment of the above described invention is described in more detail hereinafter with reference to the accompanying drawings.

The illustrated embodiment of the invention is incorporated in wrapping apparatus of the kind described in Australian patent No. 653255 (John Lysaght (Australia) Limited et al), incorporated herein by reference. Briefly stated that apparatus comprises a track structure 3 defining an endless path for a shuttle 4. The shuttle 4 carries a feed roll 5 of plastics film and in traversing its defined path orbits an object or part of an object to be wrapped. Specifically, according to the preferred embodiment described in said Australian patent No. 653255, the object is a roll of metal strip and the shuttle path extends through the bore of the object roll. The orbital movement of the shuttle creates relative rotational movement between it and the object roll, so that a web of film 6 attached to the object roll is drawn from the feed roll 5 carried by the shuttle 4 and applied to the object roll. As wrapping proceeds the object roll rotates about its own axis to ensure that the whole of the object roll is covered with wrapping film.

A stretching roller 7 is mounted on the shuttle 4 for rotation about an axis that is stationary relative to the shuttle. The web 6 is trained about that stretching roller as it departs from the feed roll 5 and travels to the object roll via an idler roller 8.

A braking roller 9, is also mounted on the shuttle 4 for rotation about an axis that is stationary relative to the shuttle, parallel to the axis of the stretching roller 7 and spaced therefrom. The braking roller 9 is in contact with the feed roll 5. The braking roller 9 is preferably surfaced with a soft elastomeric material so as to provide a high coefficient of friction and so that it is not likely to mark or damage the plastic film.

The stretching roller 7 and the braking roller 9 are connected by drive transmission means, for example a drive chain 10 running on sprockets 11 and 12 fixed to the respective rollers. In this instance the sprockets 11 and 12 are of the same diameter, thus the two rollers have the same rotational velocity, so that the larger diameter of the stretching roller 7 by comparison with that of the braking roller 9 ensures that the surface speed of the stretching roller 7 is greater than that of the braking roller 9. Friction between the outermost turn of film on the feed roll 5 and the underlying turns prevents substantial stretching of the film until after it departs from the roll as flight 13 of the drawn-off film web. As the downstream end of that flight 13 is travelling at substantially the surface speed of the stretching roller 7, and, assuming there is a substantially steady draw-off rate at the time concerned, the upstream end of the flight is travelling at substantially the surface speed of the braking roller 9, the film in flight 13 is necessarily stretched. That stretching is accomplished even though the downstream tension in the film web extending from the stretching roller to the object being wrapped may be merely sufficient to prevent the web from contracting.

The feed roll 5 is mounted for rotation upon or with a mandrel 14. That mandrel may be in the form of an axle on which either the feed roll or a spool or the like carrying the feed roll, turns, or it may be a component of such a spool or the like that turns with the roll. In any event, each end of the mandrel 14 extends through a clearance slot 15 in a side plate of the chassis of the shuttle 4 into bearing holes in a saddle 16 mounted for sliding movement along guide rods 17.

The flight 13 of the web is in tension and so pulls on the feed roll. Furthermore the direction of the flight is such that at least a component of the tension in it acts in the direction the guide rods 17. Thus the tension in the flight is effective to urge the saddles along the rods 17 and bring the feed roll 5 into pressure contact with the braking roller 9. The actual pressure between the feed roll and the braking roller due to the tension in flight 13 depends not only on the magnitude of the tension in the flight 13 but also on the geometry of the arrangement determining the angle between the flight and the guide rods. However, even at the limit where the flight is parallel to the guide rods, the braking friction due to the tension in the web at the desired degree of stretch, would not be sufficient to ensure reliable operation. Thus, in accordance with the invention, the effect of the web tension is augmented by supplementary loading means. Thus, each of the saddles 16 is urged towards the braking roller 9 by light loading springs 18 sleeved on the guide rods 17. The springs 18 are in compression between end abutments 19 and the saddle 16.

The force applied to the feed roll by the supplementary loading means, the geometry of the roll and roller axes, the length of flight 13 and the frictional coefficient between the material of the surface of the braking roller 9 and the film, may be readily selected so that the maximum attainable pressure between the braking roller 9 and the feed roll 5 is such that slippage between the braking roller 9 and the feed roll 5 will occur at a tension in the flight 13 less than the tension that would cause excessive necking down and breakage of the film. This enables satisfactory steady state operation to be obtained at a desired degree of pre-stretch while allowing for momentary slippage to accomodate sudden peaks in the film tension, such as may occur at start up or if the relative shapes of the object and the orbital path are such as to cause erratic variations in the take-up rate.

In other embodiments of the invention the pressure between the feed roll and the braking roller is established by supplementary loading means other than loading springs, for example by hydraulic or pneumatic thrusters fed from a substantially constant pressure source of working fluid.

I claim:

1. A wrapping apparatus including a shuttle for orbital movement around an object to be wrapped, the shuttle carrying a feed roll from which a web of plastic film is drawn to wrap the object, the shuttle including a pre-stretching mechanism comprising:

a braking roller mounted on the shuttle for rotation about an axis that is fixed relative to the shuttle;

a stretching roller mounted on the shuttle for rotation about an axis which is fixed relative to the shuttle, parallel to the braking roller axis and spaced therefrom, the web being drawn directly from the feed roll around the stretching roller;

drive transmission means connecting the rollers such that the surface speed of the stretching roller exceeds that of the braking roller;

mandrel means for the rotational support of a feed roll of stretch wrap film mounted on the shuttle by guide means allowing the mandrel to move freely towards the braking roller under the influence of tension in a web of film drawn directly from the feed roll and passing around the stretching roller; and supplementary loading means acting independently of the web tension to supplement the effect of the web tension in urging the feed roll towards the braking roller to maintain braking contact therebetween.

2. Wrapping apparatus according to claim 1 wherein said guide means comprise two slideable saddles respectively supporting ends of the mandrel means, and said supplementary loading means comprise springs acting between said saddles and said shuttle.

3. Wrapping apparatus according to claim 2 wherein said saddles are movable along guide rods and each of said springs is sleeved upon a respective guide rod.

4. Wrapping apparatus according to claim 1 wherein said braking roller is surfaced with a soft elastomeric material.

5. Wrapping apparatus according to claim 1 wherein said supplementary loading means are such that the maximum pressure obtained between the braking roller and the feed roll is such that slippage between the braking roller and feed roll occurs prior to the web tension reaching breaking point.

6. A method of wrapping at least part of an object in plastic film comprising the steps of:

loading a shuttle with a feed roll of the film, attaching an end of the film to the object;

causing the shuttle to orbit at least part of the object; and pre-stretching the film as it is drawn from the feed roll by the relative movement between the object and the shuttle prior to its application to the object;

wherein the feed roll is free to move bodily into contact with a braking roller under the effect of tension in the film departing from the feed roll and the step of pre-stretching the film is effected by the steps of drawing the film directly from the feed roll around the stretching roller connected to the braking roller by drive transmission means ensuring that the surface speed of the stretching roller is greater than that of the braking roller, and augmenting the effect of the tension in the film in maintaining contact between the feed roll and the braking roller by applying a supplementary force urging the feed roll towards the braking roller and having a value that is not dependent on the film tension.

7. A method according to claim 6 wherein the maximum pressure applied between the braking roller and the feed roll is such that slippage between the braking roller and feed roll occurs prior to the web tension reaching breaking point.

8. A pre-stretching mechanism for use in a wrapping apparatus in which a web of plastic film is drawn from a feed roll of film and applied to an object to be wrapped by virtue of relative rotational movement between the object and the roll, the pre-stretching mechanism comprising:

a supporting chassis;

a braking roller mounted on the chassis for rotation about an axis that is fixed relative to the chassis;

a stretching roller mounted on the chassis for rotation about an axis which is fixed relative to the chassis, parallel to the braking roller axis and spaced therefrom, the web being drawn directly from the feed roll around the stretching roller;

drive transmission means connecting the rollers such that the surface speed of the stretching roller exceeds that of the braking roller;

mandrel means for the rotational support of a feed roll mounted on the chassis by guide means allowing the mandrel means to move freely towards the braking roller under the influence of tension in a web drawn directly from the feed roll and passing around the stretching roller; and supplementary loading means acting independently of the web tension and supplementing the web tension in urging the feed roll towards the braking roller to maintain braking contact therebetween at a pressure such that slippage between the braking roller and feed roll occurs prior to the web tension reaching breaking point.

* * * * *